US009308752B2

(12) United States Patent
Usuda et al.

(10) Patent No.: US 9,308,752 B2
(45) Date of Patent: Apr. 12, 2016

(54) PRINTING APPARATUS USING PHOTOCURABLE INK AND METHOD FOR PRODUCING PRINTED MATERIAL

(71) Applicant: SEIKO EPSON CORPORATION, Tokyo (JP)

(72) Inventors: Hidenori Usuda, Matsumoto (JP); Shinichi Kamoshida, Saitama (JP); Takuya Fujita, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 13/753,254

(22) Filed: Jan. 29, 2013

(65) Prior Publication Data

US 2013/0201266 A1 Aug. 8, 2013

(30) Foreign Application Priority Data

Feb. 6, 2012 (JP) ..... 2012-023270

(51) Int. Cl.
*B41J 2/01* (2006.01)
*B41J 11/00* (2006.01)
*B41J 2/435* (2006.01)

(52) U.S. Cl.
CPC ..... *B41J 11/002* (2013.01); *B41J 11/0015* (2013.01); *B41J 2/435* (2013.01)

(58) Field of Classification Search
CPC ..... B41J 11/002; B41J 11/0015
USPC ..... 347/101, 102, 104–106
See application file for complete search history.

(56) References Cited

U.S. PATENT DOCUMENTS

| | | | | |
|---|---|---|---|---|
| 5,751,303 | A * | 5/1998 | Erickson et al. | 347/16 |
| 2007/0008394 | A1 * | 1/2007 | Mashima | 347/104 |
| 2008/0079795 | A1 * | 4/2008 | Nakazawa | 347/102 |
| 2009/0231407 | A1 * | 9/2009 | Kachi | 347/104 |
| 2011/0221818 | A1 | 9/2011 | Furuhata et al. | |
| 2012/0081451 | A1 * | 4/2012 | Kondo et al. | 347/19 |
| 2012/0127237 | A1 * | 5/2012 | Usuda et al. | 347/21 |
| 2013/0044170 | A1 * | 2/2013 | Chiwata | 347/102 |
| 2013/0063534 | A1 * | 3/2013 | Akamine | 347/102 |

FOREIGN PATENT DOCUMENTS

| | | | |
|---|---|---|---|
| JP | 2001-030519 | A | 2/2001 |
| JP | 2003-508277 | A | 3/2003 |
| JP | 2007-152740 | A | 6/2007 |
| JP | 4333969 | B2 | 9/2009 |
| JP | 2010-162754 | A | 7/2010 |
| WO | 01/17780 | A1 | 3/2001 |

* cited by examiner

*Primary Examiner* — Henok Legesse
(74) *Attorney, Agent, or Firm* — Maschoff Brennan

(57) ABSTRACT

A recording apparatus that uses photocurable ink includes an ink discharge section that discharges photocurable ink onto a printing medium, a light irradiation section that irradiates curing light onto the photocurable ink that has been discharged onto the printing medium, a tension application mechanism that applies tension to the printing medium and a control section. The control section discharges photocurable ink onto the printing medium by controlling the ink discharge section, and subsequently applies a tension, which is greater than that at the time of ink discharge, to the printing medium by controlling the tension application mechanism, and irradiates curing light onto the photocurable ink that has been discharged onto the printing medium by controlling the light irradiation section in a state in which the tension is being applied to the printing medium.

9 Claims, 8 Drawing Sheets

PRINTING APPARATUS USING PHOTOCURABLE INK AND METHOD FOR PRODUCING PRINTED MATERIAL

BACKGROUND

1. Technical Field

The present invention relates to a printing apparatus that uses photocurable ink which includes an ink discharge section that discharges the photocurable ink onto a cloth (printing medium) that is transported, and a light irradiation section that irradiates curing light onto the photocurable ink that has been discharged onto the cloth and a method for producing a printed material.

2. Related Art

Examples of printing apparatuses of the related art that use this kind of photocurable ink include the printer disclosed in JP A-2010-162754. This document discloses a structure which uses ultraviolet-curable ink and includes an ultraviolet irradiation section.

However, printing an image on a printing medium using the ultraviolet-curable ink in JP A-2010-162754 has not been considered at all.

If ultraviolet-curable ink is discharged onto a printing medium, the ink becomes attached to the surface of the printing medium and there is little penetration into the interior of a fiber. That is, there is a tendency for the association of the ink with the fiber to be insufficient. In addition, since there are a great deal of fibers that have fluff on the surface of the printing medium, in a case in which such a fiber is used, there are cases in which a significant amount of the ultraviolet-curable ink becomes attached to the fluff.

If the ink is cured by the irradiation of ultraviolet light in such a state, the ink is cured in a state in which the association of the ink with the fiber is not favorable. In addition, curing is performed in a state in which a great deal of the ink is attached to the fluff. If such a printing medium is commercialized as a product and provided for use as clothing, a packing device or the like, there is concern that a problem arises in which the cured ink tends to peel off as a result of friction or impacts.

In addition, in a case in which the printing medium is a mesh fabric that includes apertures in a lattice shape, problems such as a state in which ink is attached to the edges of the apertures of the mesh fabric and blocking the apertures or the contact area of the ink and the fiber being small can occur from merely discharging ultraviolet-curable ink onto the mesh fabric. If the ink is cured by irradiating ultraviolet light in this state, there is concern that a problem arises in which the apertures of the mesh fabric become blocked and the cured ink tends to peel off from the mesh fabric.

SUMMARY

An advantage of some aspects of the invention is that the concern of cured ink peeling off and apertures of mesh fabric being blocked is reduced when printing an image on a printing medium using photocurable ink.

In order solve the abovementioned problem, according to an aspect of the invention, there is provided a printing apparatus that uses photocurable ink which includes an ink discharge section that discharges photocurable ink onto a printing medium that is transported relatively, a light irradiation section that irradiates curing light onto the photocurable ink that has been discharged onto the printing medium, a tension application mechanism that applies a tension to the printing medium, and a control section that controls the respective actions of the ink discharge section, the light irradiation section and the tension application mechanism, in which the control section discharges the photocurable ink onto the printing medium by controlling the ink discharge section, and subsequently applies a tension, which is greater than that at the time of ink discharge, to the printing medium by controlling the tension application mechanism, and irradiates curing light onto the photocurable ink that has been discharged onto the printing medium by controlling the light irradiation section in a state in which the tension is being applied to the printing medium.

In this case, the term "printing medium" indicates a "cloth" that is to be a target for printing, and includes natural fibers such as cotton, silk, wool and the like, artificial fibers such as nylon, and fabrics, knitted fabrics, non-woven fabrics and the like made of composite fibers in which the abovementioned fibers have been mixed. The term also includes both long fabrics that have been wound into a rolled form and fabrics that have been cut to a predetermined length. Furthermore, in addition to finished sewn products such as handkerchiefs, scarves, towels, curtains, sheets, bedcovers and the like, it also includes pre- and post-cutting textiles and the like that are parts of a unfinished sewn products.

In the specification of the application, the term "printing" indicates printing on the abovementioned printing material. In addition, "photocurable ink" indicates ink that is cured by the irradiation of light or electromagnetic waves in the same manner as ultraviolet-curable ink.

According to the aspect, after the photocurable ink has been discharged onto the printing medium, a tension, which is greater than that at the time of ink discharge, is applied to the printing medium by controlling the tension application mechanism. According to this configuration, since it is possible to set the printing medium to be in a slightly stretched state, the discharged photocurable ink becomes associated with the fiber and the contact area thereof with the fiber is increased.

Further, curing light is irradiated onto the photocurable ink that has been discharged onto the printing medium by controlling the light irradiation section in a state in which the tension is being applied. According to this configuration, it is possible to cure the photocurable ink in a state in which the foregoing is solidly attached to the fiber. Therefore, in a case in which an image is printed onto a printing medium using photocurable ink, it is possible to reduce the concern of cured ink peeling off from the printing medium and apertures of the printing medium becoming blocked.

In the printing apparatus that uses photocurable ink, the control section may discharge the photocurable ink onto the printing medium by controlling the ink discharge section, apply the tension, which is greater than that at the time of ink discharge, to the printing medium by controlling the tension application mechanism, subsequently change to a lower tension application state than that of the high tension that was applied, and irradiate curing light onto the photocurable ink that has been discharged onto the printing medium by controlling the light irradiation section.

In this case, the description "changes to a lower tension application state than that of the high tension that was applied" is used to include a meaning of removing the high tension application state and returning to an original state, that is setting the tension to be the same as the tension which is applied to a printing medium at the time of the discharge of photocurable ink onto the printing medium.

According to the aspect, the feature of the tension, which is greater than that at the time of ink discharge, being applied to the printing medium by controlling the tension application mechanism is the same as the first aspect. However, the aspect differs in a feature of subsequently changing to a lower tension application state than that of the high tension that was applied and irradiating curing light onto the photocurable ink that has been discharged onto the printing medium by controlling the light irradiation section.

Even with this difference, since the printing medium is in a slightly stretched state due to the application of the tension, it is possible to obtain the same effect as the first aspect whereby the discharged photocurable ink becomes associated with the fiber and the contact area thereof with the fiber is increased.

In addition, since it is possible to cure the photocurable ink using the light irradiation section in a state in which the high tension has been removed, there is very little change in the state of fiber before and after curing and it is possible to secure a stable product.

If the application of the high tension and the application of low tension or the removal of the tension are repeated, the effect of the ink becoming associated with the fiber is improved.

In the printing apparatus that uses photocurable ink, the ink discharge section and the light irradiation section may be capable of moving along a transport direction of the printing medium, and the control section may discharge photocurable ink while moving the ink discharge section in the transport direction, and subsequently irradiate curing light onto the photocurable ink that has been discharged onto the printing medium while moving the light irradiation section along the transport direction after the tension application process.

In this case, the light irradiation section may be provided as a separate entity to the ink discharge section or may be provided integrally with the ink discharge section. In a case in which the two components are provided integrally, the apparatus is configured such that the ink discharge section is caused to function during the initial movement, and the light irradiation section is caused to function by returning the ink discharge section and causing the entity to move again.

According to the aspect, since the ink discharge section and the light irradiation section are configured to be capable of moving along a transport direction of the printing medium, the control section can discharge photocurable ink while moving the ink discharge section in the transport direction, and subsequently irradiate curing light onto the photocurable ink that has been discharged onto the printing medium while moving the light irradiation section along the transport direction after the tension application process. According to this configuration, it is possible to perform the application of the tension to the printing medium and the removal of the tension from the printing medium with a simple structure.

In the printing apparatus that uses photocurable ink according to the second aspect, the light irradiation section may be positioned further downstream in the transport direction of the printing medium than the ink discharge section, the printing medium may be transported so as to receive ink discharge and light irradiation by the positions that the ink discharge section and the light irradiation section face being sequentially passed thereover, the tension application mechanism may include a medium retention section that is provided upstream of the light irradiation section and on the side of the printing medium that is opposite the light irradiation section, and a tension adjustment section that is provided further downstream in the transport direction than the light irradiation section, and the control section may cause the medium retention section and the tension adjustment section to function and apply the tension to a printing medium that is held between the medium retention section and the tension adjustment section.

According to the aspect, unlike the above aspect, it is possible to perform the application of the tension to the printing medium and the removal of the tension from the printing medium with respect to a fixed structure in which the ink discharge section and the light irradiation section do not move in the transport direction. That is, it is also possible to have a structure in which the light irradiation section is positioned further downstream in the transport direction of the printing medium than the ink discharge section and the printing medium is transported so as to receive ink discharge and light irradiation by the positions that the ink discharge section and the light irradiation section face being sequentially passed thereover. By adjusting the tension adjustment section using the control section, it is also possible to perform the application of the tension with a simple configuration.

In the printing apparatus that uses photocurable ink, the medium retention section may be provided upstream of the light irradiation section and on the side of the printing medium that is opposite the light irradiation section, and include a needle-tipped member that performs a contact/separation movement with the surface of the above-referenced opposite side of the printing medium, and the tension adjustment section may be provided further downstream than the light irradiation section and include a tension application roller that moves in a direction that intersects the transport direction.

According to the aspect, it is possible to apply a predetermined tension to the printing medium by moving the needle-tipped member and migrating the foregoing from a separation state to a contact state with respect to the printing medium, retaining the printing medium with the needle thereof and moving the tension application roller in a direction of tension application in this state.

In the printing apparatus that uses photocurable ink, the light irradiation section may be positioned further downstream in the transport direction of the printing medium than the ink discharge section, the printing medium may be transported so as to receive ink discharge and light irradiation by the positions that the ink discharge section and the light irradiation section face being sequentially passed thereover, the tension application mechanism may include a first medium retention section that is provided upstream of the light irradiation section and on the side of the printing medium that is opposite the light irradiation section, and a second medium retention section that is provided further downstream in the transport direction than the light irradiation section, and the control section may cause the first medium retention section and the second medium retention section to function and apply the tension to the printing medium that is held between the first medium retention section and the second medium retention section.

According to the aspect, in the same manner as the fourth aspect, it is possible to perform the application of the tension to the printing medium and the removal of the tension from the printing medium with respect to a fixed structure in which the ink discharge section and the light irradiation section do not move in the transport direction. Since it is also possible to easily perform the application of the tension by either one or both of the first medium retention section and the second medium retention section, the degree of freedom of the design is improved.

In the printing apparatus that uses photocurable ink, the first medium retention section may include a needle-tipped roller that is provided upstream of the light irradiation section and on the side of the printing medium that is opposite the light irradiation section and the second medium retention section may include a friction transfer roller that is provided further downstream than the light irradiation section.

According to the aspect, since the tension application mechanism is configured of a combination of a needle-tipped roller and a friction transfer roller, in addition to a function of transporting the printing medium in the transport direction, the friction transfer roller and the like can also serve a function of applying the tension.

According to another aspect of the invention, there is provided a method for producing a printed material that is executed by using the printing apparatus that uses photocurable ink according to any one of the first to seventh aspects on a printing medium formed of a mesh fabric that includes apertures.

According to the aspect, it is possible to cure photocurable ink in a state in which the foregoing is solidly attached to the fiber, and it is possible to produce a printed material in which it is not likely that cured ink will peel off. Alternatively, it is possible to a produce printed material with a small ratio of blocked mesh fabric apertures.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
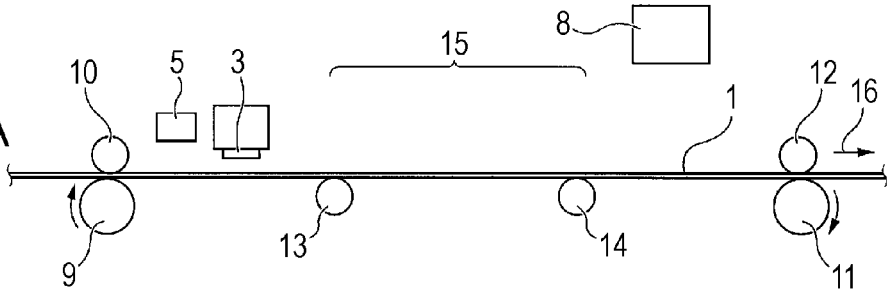
FIGS. 1A to 1E are sectional side views that show a skeleton framework of the main parts of a printing apparatus that uses photocurable ink according to the first embodiment of the invention.

Hereinafter, the structures of printing apparatuses that use photocurable ink according to the present application and methods for producing a printed material, which are executed by using printing apparatuses that use photocurable ink will be described on the basis of first to fifth embodiments.

First Embodiment

FIGS. 1A to 1E

As shown in FIGS. 1A to 1E, a printing apparatus that uses photocurable ink according to the first embodiment of the invention includes an ink discharge section 3 that discharges ultraviolet-curable ink (referred to as "UV ink" below) 2, which is an example of a photocurable ink, onto a printing medium 1 that is transported, a light irradiation section 5 that irradiates ultraviolet light (referred to as "UV light" below) 4, which is curing light, onto the UV ink 2 that has been discharged onto the printing medium 1, a tension application mechanism 7 that applies a tension to the printing medium 1, and a control section 8 that controls the respective actions of the ink discharge section 3, the light irradiation section 5 and the tension application mechanism 7.

Further, the control section 8 is configured so as to discharge the UV ink 2 onto the printing medium 1 by controlling the ink discharge section 3, and subsequently apply a tension 6, which is greater than that at the time of ink discharge, to the printing medium 1 by controlling the tension application mechanism 7, and irradiate UV light 4 onto the UV ink 2 that has been discharged onto the printing medium 1 by controlling the light irradiation section 5 in a state in which the tension 6 is being applied.

Further, in the embodiment, the ink discharge section 3 and the light irradiation section 5 are capable of moving along a transport direction 16 of the printing medium 1. Furthermore, the control section 8 is configured so as to discharge UV ink 2 while moving the ink discharge section 3 in the transport direction 16, and subsequently irradiate UV light 4 onto the UV ink 2 that has been discharged onto the printing medium 1 while moving the light irradiation section 5 along the transport direction 16 in a state in which the tension 6 is being applied after the application process of the tension 6.

In the embodiment, the ink discharge section 3 has a serial type structure and is configured so as to print to the printing medium 1 by moving intermittently in the transport direction 16 and discharging ink while performing a reciprocating movement in a direction that is perpendicular to the surface of the paper in FIGS. 1A to 1E.

In the embodiment, the light irradiation section 5 is configured as a separate entity to the ink discharge section 3. In addition, the light irradiation section 5 has a similar serial structure to that of the ink discharge section 3.

Additionally, the ink discharge section 3 may have a line head structure which can print to the entirety of a width direction that intersects the transport direction of the printing medium 1 in one pass. In such a case, it is preferable for the light irradiation section 5 to also have a line structure which can irradiate light across the entire width of the printing medium 1 in one pass.

The transport of the printing medium 1 is performed using a first friction driving roller 9, a first pair of friction driven rollers 10, a second friction driving roller 11 that is provided separated in the transport direction 16 and a second pair of friction driven rollers 12. Further, retention rollers 13 and 14 that retain the printing medium 1 at a set height are provided between both pairs of rollers, and the space in-between these retention rollers 13 and 14 forms an ink discharge region 15 of the ink discharge section 3.

In the embodiment, the tension application mechanism 7 is configured by a movement mechanism in which the second friction driving roller 11 and the second pair of friction driven rollers 12 cause the printing medium 1 to move in the transport direction 16 in a pinched state.

Next, the action of the printing apparatus according to the first embodiment, that is, the control function of the control section 8 will be described on the basis of FIGS. 1A to 1E and FIG. 5.

Figure 5:
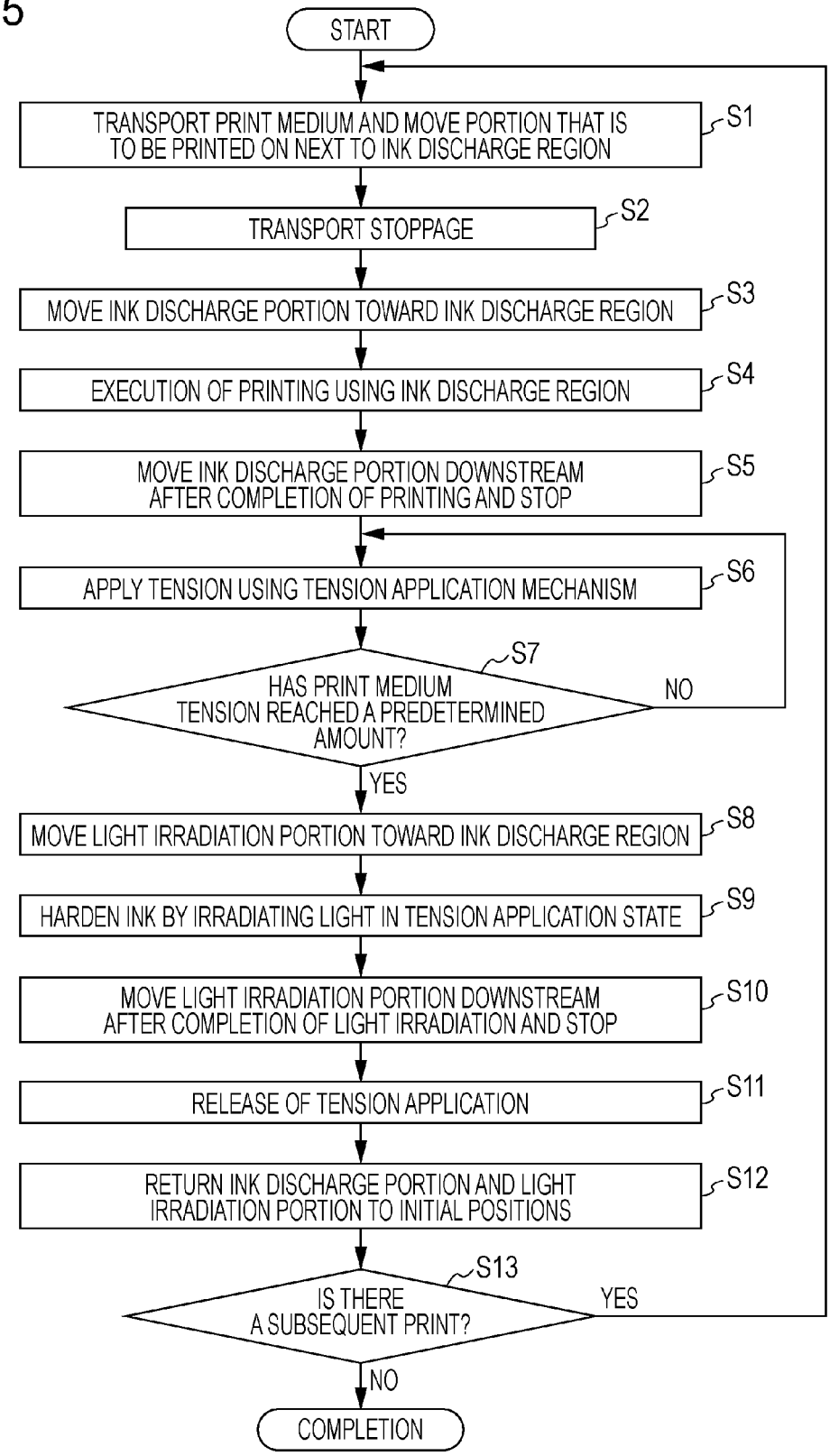
FIG. 5 is a flowchart that describes a control flow of the control section of a printing apparatus that uses photocurable ink according to the first embodiment of the invention.

Firstly, FIG. 1A is a state in which the printing medium 1 is being transported in the transport direction using the first friction driving roller 9, the first pair of friction driven rollers 10, the second friction driving roller 11 and the second pair of friction driven rollers 12 (Step S1 in FIG. 5). Transport is stopped when the portion of the printing medium 1 that is to be printed on next arrives at the ink discharge region 15 (Step S2 in FIG. 5).

Figure 1B:
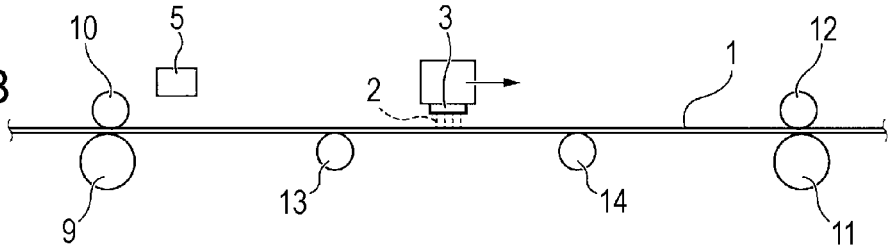

FIG. 1B shows a state in which the ink discharge section 3 is moved from an initial position and discharges ink onto the ink discharge region 15 of the printing medium 1 in a state in which transport thereof has been stopped (Steps S3 and S4 in FIG. 5).

Additionally, the timing of the start of movement of the ink discharge section 3 from the initial position thereof is not limited to after the transport of the printing medium 1 has been stopped. In order to be able to start printing rapidly after the transport of the printing medium 1 has been stopped, the movement of the ink discharge section 3 may be started during transport of the printing medium 1, that is, a timing before stopping the transport.

Figure 1C:
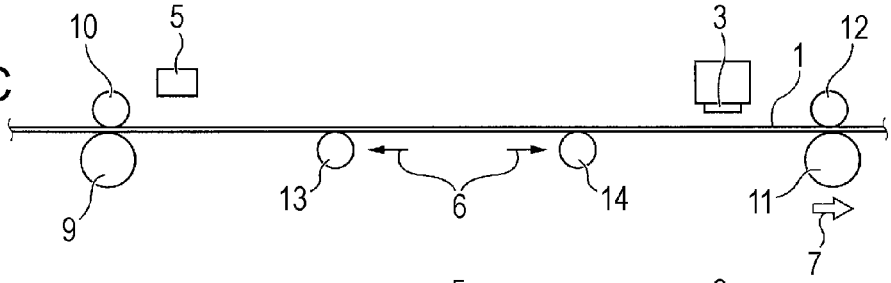

FIG. 1C shows a state in which the tension 6, which is greater than that at the time of ink discharge, has been applied to the printing medium 1 using the tension application mechanism 7 (Steps S6 and S7 in FIG. 5) after the ink discharge section 3 has finished ink discharge in the ink discharge region 15, moved downstream of the ink discharge region 15 in the transport direction and stopped at a predetermined position (Step S5 in FIG. 5).

Additionally, in the above description of FIG. 1C, the tension 6 is applied using the tension application mechanism 7 after the downstream movement of the ink discharge section 3 has been stopped, but the tension application function may be started during the movement of the ink discharge section 3 after the ink discharge section 3 has finished ink discharge in the ink discharge region 15 and started to move downstream. By adopting such a configuration, it is possible to achieve a reduction in printing time.

Figure 1D:
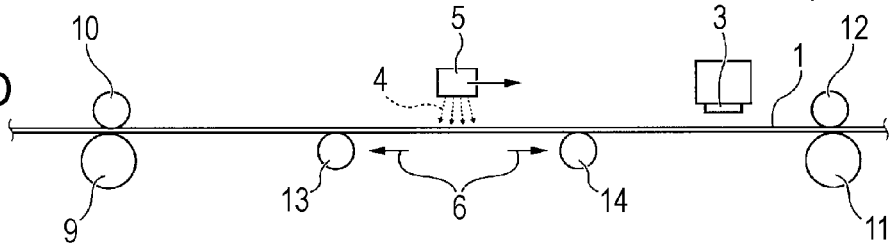

FIG. 1D shows a state in which the light irradiation section 5 is moved in the transport direction 16 from an initial position after the tension 6 has been applied to the printing medium 1, and with respect to the printing medium 1 in state in which the tension 6 is being applied, UV ink 2 that is discharged onto the printing medium 1 in the ink discharge region 15 is cured by UV light being irradiated thereon (Steps S8 and S9 in FIG. 5).

Additionally, the timing of the start of movement of the light irradiation section 5 from the initial position thereof is not limited to after the tension 6 has been applied to the printing medium 1 and may be a timing before the foregoing. That is, in order to be able to start light irradiation rapidly after the tension 6 has been applied to the printing medium 1, the movement of the light irradiation section 5 from the initial position thereof may be started during the tension application function using the tension application mechanism 7.

Figure 1E:
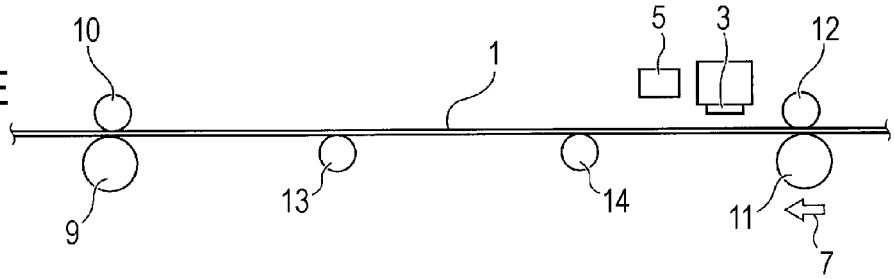
Figure 2A:
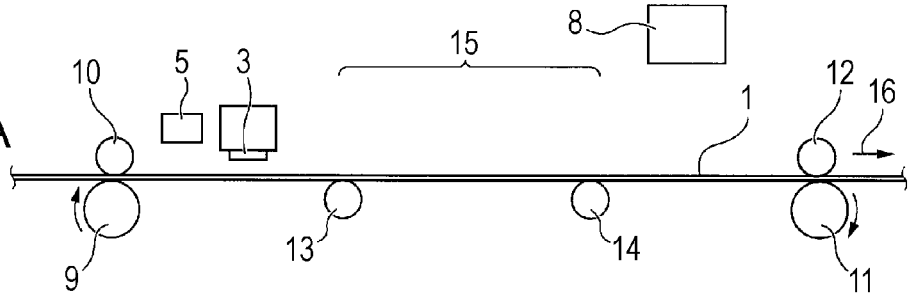
FIGS. 2A to 2E are sectional side views that show a skeleton framework of the main parts of a printing apparatus that uses photocurable ink according to the second embodiment of the invention.
Figure 2B:
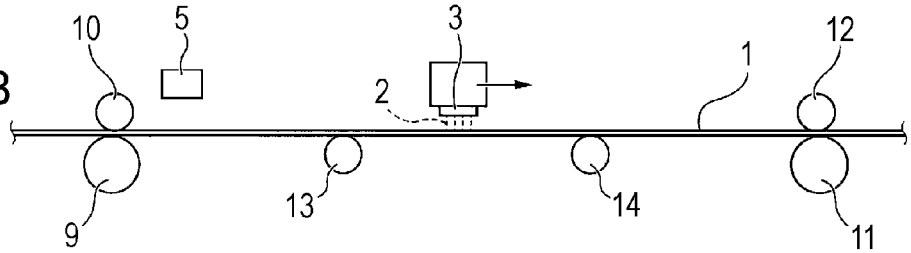
Figure 2C:
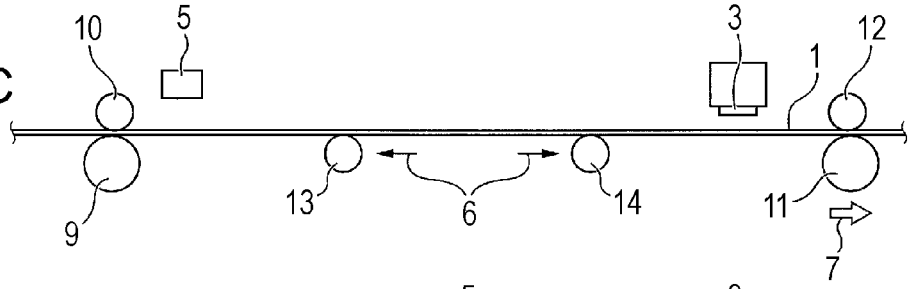
Figure 2D:
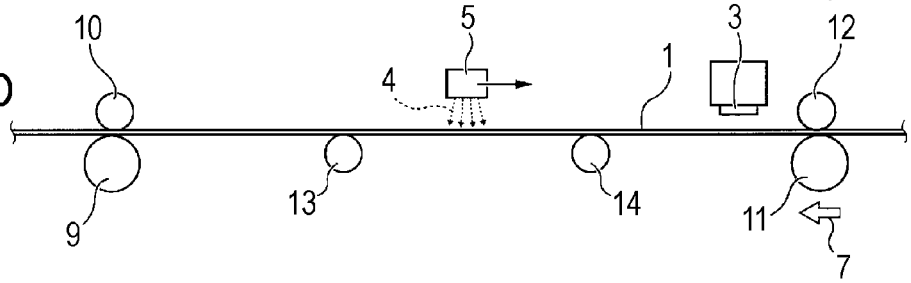
Figure 2E:
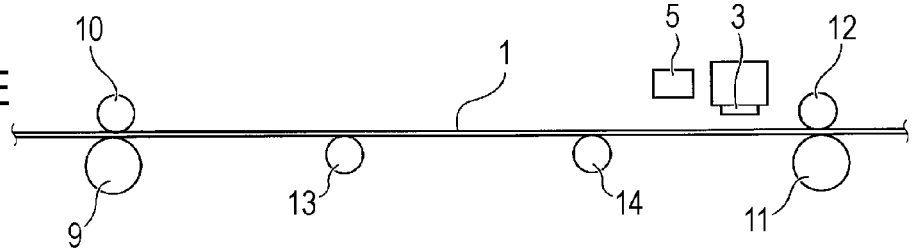

FIG. 1E shows a state in which the tension application mechanism 7 has been returned to the original state thereof after the light irradiation section 5 has finished light irradiation in the ink discharge region 15 and stopped moving downstream (Steps S10 and S11 in FIG. 5).

Additionally, the timing of the return of the tension application mechanism 7 to the original state thereof is not limited to after the downstream movement of the light irradiation section 5 has stopped. The tension application mechanism 7 may be returned to the original state thereof, that is, the application of the tension may be removed during movement after the light irradiation section 5 has finished light irradiation and has started to move downstream.

Next, the ink discharge section 3 and the light irradiation section 5 are returned from the state in FIG. 1E to the initial positions thereof in FIG. 1A (Step S12 in FIG. 5). Further, the processes of FIG. 1A to FIG. 1E are repeated in the same manner for subsequent printing operations (Step S13 in FIG. 5). In a case in which the processes are repeated, since it is possible to set the position of the ink discharge section 3 at the start of printing to be the same position, it is possible to avoid complicated data processing since it is not necessary to invert print data or change the process sequence.

It is also possible to start the next printing process from the state in FIG. 1E without repeating the abovementioned processes of FIG. 1A to FIG. 1E. In such a case, the ink discharge section 3 and the light irradiation section 5 move from the state of FIG. 1E so that they reach the state of FIG. 1B. Since the processes thereafter from FIG. 1B to FIG. 1E are the same as those described above, description thereof will be omitted.

In such a case, since the position of the ink discharge section 3 at the start of printing is different from that of FIG. 1A, it is necessary to perform data processing such as the inversion of print data or changing of the process sequence. However, since it is not necessary to move the ink discharge section 3 to the initial position shown in FIG. 1A, it is possible to reduce the printing time in comparison with repetition of the processes of FIG. 1A to FIG. 1E.

Additionally, in the above description of FIG. 1E, after the light irradiation section 5 has finished light irradiation in the ink discharge region 15, the foregoing is set to move downstream and stop in the same manner as the ink discharge section 3. However, the light irradiation section 5 may move toward the initial position thereof shown in FIG. 1A and stop without moving downstream after the foregoing has finished light irradiation in the ink discharge region 15. In such a case, it is preferable that the ink discharge section 3 that is stopped downstream also move toward the initial position thereof in the same manner as the light irradiation section 5.

According to the first embodiment, the control section 8 applies the tension 6, which is greater than that at the time of ink discharge, to the printing medium 1 by controlling the tension application mechanism 7 after the UV ink 2 has been discharged onto the printing medium 1. According to this configuration, the printing medium 1 is put into a state in which it is stretched slightly more than at the time of ink discharge. By adopting the above configuration, the discharged UV ink 2 becomes associated with the fiber of the printing medium 1 and the contact area thereof with the fiber is increased. Further, the control section 8 irradiates UV light 4 onto the UV ink 2 that has been discharged onto the printing medium 1 by controlling the light irradiation section 5 in a state in which the tension 6 is being applied.

According to this configuration, it is possible to cure the UV ink 2 in a state in which the foregoing is solidly attached to the fiber. By adopting the above configuration, in a case in which an image is printed on the printing medium 1 using the UV ink 2, it is possible to reduce the concern of cured ink peeling off from the printing medium 1 and apertures of a mesh fabric becoming blocked by ink in a case in which the printing medium 1 is a mesh fabric.

Second Embodiment

FIGS. 2A to 2E

As shown in FIGS. 2A to 2E, in a printing apparatus that uses photocurable ink according to the second embodiment of the invention, the control section 8 discharges the UV ink 2 onto the printing medium 1 by controlling the ink discharge section 3 (FIGS. 2A and 2B), applies the tension 6, which is greater than that at the time of ink discharge, to the printing medium 1 by controlling the tension application mechanism 7 (FIG. 2C), and subsequently changes to a lower tension application state than that of the high tension 6 that was applied (FIG. 2D) and irradiates UV light 4 onto the UV ink 2 that has been discharged onto the printing medium 1 by controlling the light irradiation section 5.

Additionally, in the same manner as the first embodiment, the timing of the start of movement of the ink discharge section 3 from the initial position thereof, the timing of the application of the tension using the tension application mechanism 7 or the timing of the removal of the tension, the timing of the start of movement of the light irradiation section 5 from the initial position thereof, the timing of the returning of the ink discharge section 3 and the light irradiation section 5 to the initial positions thereof and the like in the second embodiment are not limited to the timings in FIGS. 2A to 2E and it is possible to perform the foregoing with various timings.

The abovementioned application of low tension may be removing the application state of the large tension 6 and returning to the original tension application state. That is, the foregoing may be the same tension as that which is applied to the printing medium 1 at the time of the discharge of UV ink 2 onto the printing medium 1. Alternatively, the tension may be a tension that is slightly higher or lower than the original tension.

According to the second embodiment, the feature of the tension 6, which is greater than that at the time of ink discharge, being applied to the printing medium 1 by controlling the tension application mechanism 7 is the same as the first aspect. However, the embodiment differs in a feature of subsequently changing to a lower tension application state than that of the high tension 6 that was applied and irradiating UV light 4 onto the UV ink 2 that has been discharged onto the printing medium 1 by controlling the light irradiation section 5.

Even with this difference, since the printing medium 1 is in a slightly stretched state due to the application of the tension 6, it is possible to obtain the same effect as the first aspect whereby the discharged UV ink 2 becomes associated with the fiber and the contact area thereof with the fiber is increased.

In addition, since it is possible to cure the UV ink 2 in a state in which the high tension 6 has been removed, there is no change in the state of fiber before and after curing and it is possible to secure a stable product.

If the application of the high tension 6 and the application of the low tension or the removal of the tension are repeated, the effect of the ink becoming associated with the fiber is improved.

Third Embodiment

FIGS. 3A to 3E

As shown in FIGS. 3A to 3E, in a printing apparatus that uses photocurable ink according to the third embodiment of the invention, the light irradiation section 5 is provided integrally with the ink discharge section 3 rather than the two components being formed as separate entities. Since the rest of the configuration of the printing apparatus is the same as the first embodiment, the same reference numerals apply to the same parts and the description thereof will be omitted ((A) to (E) in FIGS. 3A to 3E).

Figure 3A:
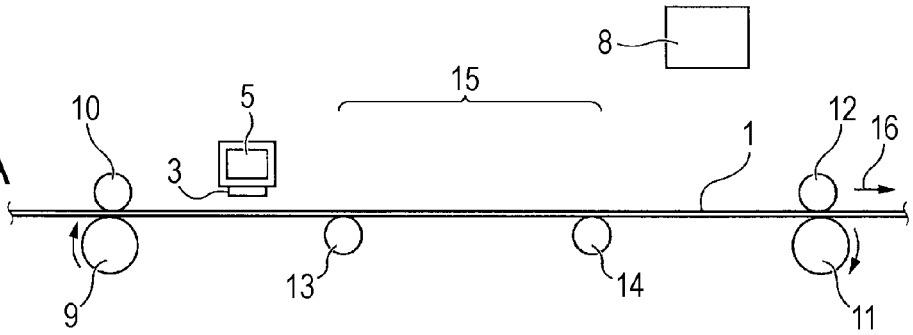
FIGS. 3A to 3E are sectional side views that show a skeleton framework of the main parts of a printing apparatus that uses photocurable ink according to the third embodiment of the invention.
Figure 3B:
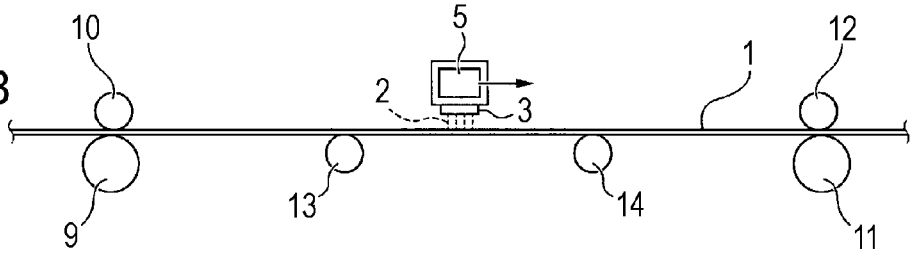
Figure 3C:
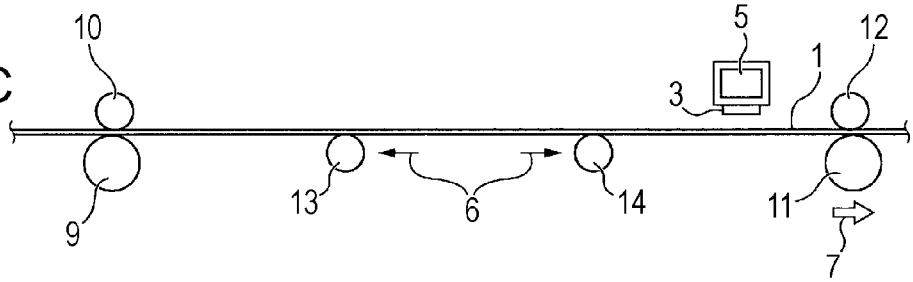
Figure 3D:
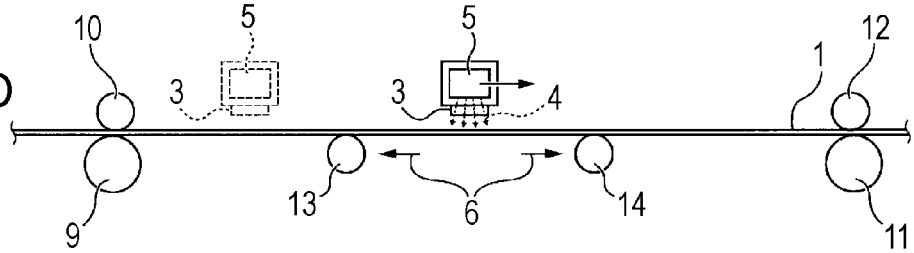

As shown in FIGS. 3C and 3D, in the embodiment, when UV light 4 is irradiated by the light irradiation section 5 onto the UV ink 2 that has been discharged from the ink discharge section 3 onto the printing medium 1, the printing apparatus is configured such that the integral ink discharge section 3 and light irradiation section 5 is returned to the movement starting position thereof (the position shown by the broken line in FIG. 3D) and the light irradiation section 5 is moved in the transport direction 16 again.

Additionally, in FIGS. 3B to 3D, the ink discharge section 3 is moved downstream of the ink discharge region 15 (FIG. 3C) after ink discharge has been completed (FIG. 3B), and returned to the movement starting position thereof (FIG. 3D) after the high tension 6 has been applied. However, the ink discharge section 3 (and the light irradiation section 5) may be directly returned to the movement starting position thereof after the ink discharge in FIG. 3B has been completed.

Figure 3E:
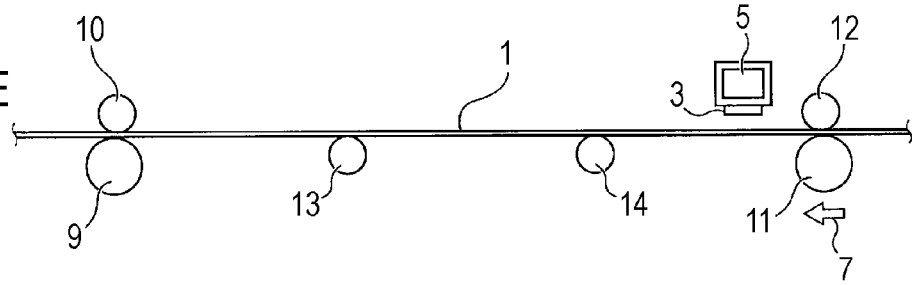

Furthermore, in FIGS. 3D and 3E, the printing apparatus is configured so that the light irradiation section 5 moves further downstream than the ink discharge region 15 (FIG. 3E) after light irradiation has been completed (FIG. 3D), the tension 6 is removed and thereafter, the light irradiation section 5 returns to the movement starting position thereof. However, the light irradiation section 5 may be directly returned to the movement starting position thereof after the light irradiation in FIG. 3D has been completed.

In the same manner as the first and second embodiments, the timing of the start of movement of the ink discharge section 3 from the initial position thereof, the timing of the application of the tension using the tension application mechanism 7 or the timing of the removal of the tension, the timing of the start of movement of the light irradiation section 5 from the initial position thereof, the timing of the returning of the ink discharge section 3 and the light irradiation section 5 to the initial positions thereof and the like in the third embodiment are not limited to the timings in FIGS. 3A to 3E and it is possible to perform the foregoing with various timings.

Figure 6:
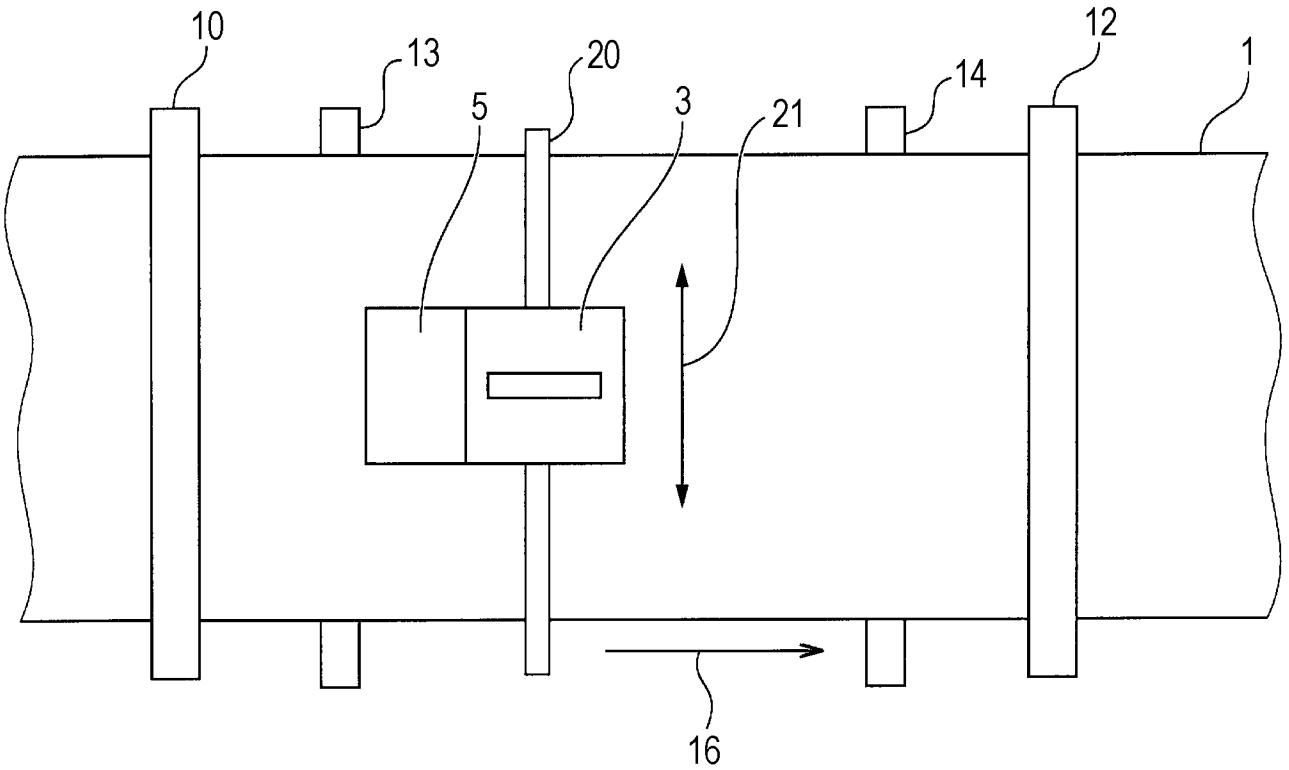
FIG. 6 is an outline plan view of the main parts of a printing apparatus that uses photocurable ink according to the third embodiment of the invention.

FIG. 6 shows an outline plan view of the main parts of a printing apparatus that uses photocurable ink according to the third embodiment of the invention. In FIG. 6, reference symbol 20 is a guide axis for moving the ink discharge section 3 and the light irradiation section 5 in a width direction 21 of the printing medium 1 that intersects the transport direction 16. The movement mechanism for moving the ink discharge section 3 and the light irradiation section 5 in the transport direction has a publicly-known structure and therefore, the foregoing is omitted from the drawings.

Additionally, in FIG. 6, the structure differs from that of FIG. 4 in the feature of the light irradiation section 5 being positioned downstream of the ink discharge section 3 and formed integrally therewith, but the rest of the structure is the same as that of FIGS. 4A to 4E.

Fourth Embodiment

FIGS. 4A to 4E

As shown in FIGS. 4A to 4E, in a printing apparatus that uses photocurable ink according to the fourth embodiment of the invention, the light irradiation section 5 is positioned further downstream in the transport direction 16 of the printing medium 1 than the ink discharge section 3. Further, the printing medium 1 is transported so as to receive ink discharge and light irradiation by the positions that the ink discharge section 3 and the light irradiation section 5 face being sequentially passed thereover.

The tension application mechanism 7 includes a needle-tipped roller 17, which is an example of a first medium retention section, that is provided upstream of the light irradiation section 5 and on the side of the printing medium 1 that is opposite the light irradiation section 5, and a friction transfer roller (the second friction driving roller 11 and the second pair of friction driven rollers 12), which is an example of a second medium retention section, that is provided further downstream in the transport direction 16 than the light irradiation section 5.

Additionally, the first medium retention section and the second medium retention section are not limited to the needle-tipped roller 17 and the friction transfer roller. For example, an adhesion roller which has an adhesion surface or the like can be used.

In the embodiment, the control section 8 causes the needle-tipped roller 17 and the friction transfer rollers 11 and 12 to function so that the tension 6 is applied to a printing medium 1 that is held between both rollers. More specifically, the application of the tension 6 (FIG. 4B) is realized by moving the friction transfer rollers 11 and 12 in the transport direction 16 while the printing medium 1 is retained by the foregoing in a pinched state in a state in which the movement of the needle-tipped roller 17 has been stopped.

Additionally, a structure in which the needle-tipped roller 17 is moved in the direction opposite the transport direction 16 in a state in which the movement of the friction transfer rollers 11 and 12 have been stopped or a structure in which the needle-tipped roller 17 and the friction transfer rollers 11 and 12 are moved in the transport direction 16 so as to be separated from one another may be used as the tension application structure.

Since the rest of the structure of the printing apparatus is the same as the first embodiment, the same reference numerals apply to the same parts and the description thereof will be omitted.

Figure 4A:
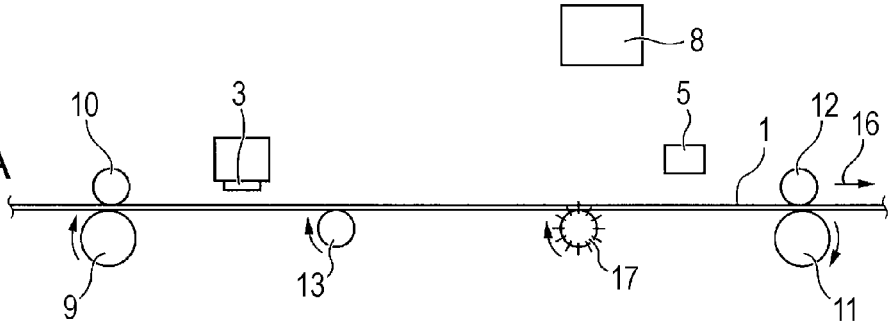
FIGS. 4A to 4E are sectional side views that show a skeleton framework of the main parts of a printing apparatus that uses photocurable ink according to the fourth embodiment of the invention.
Figure 4B:
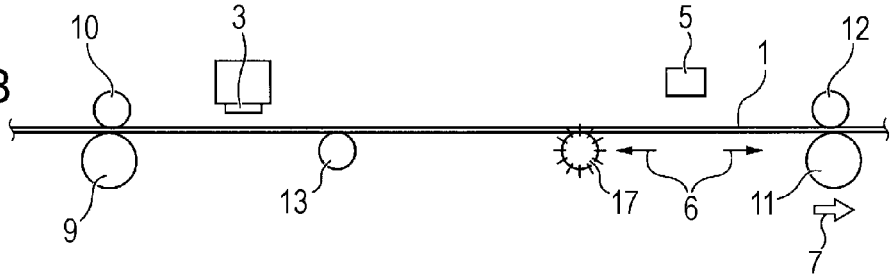
Figure 4C:
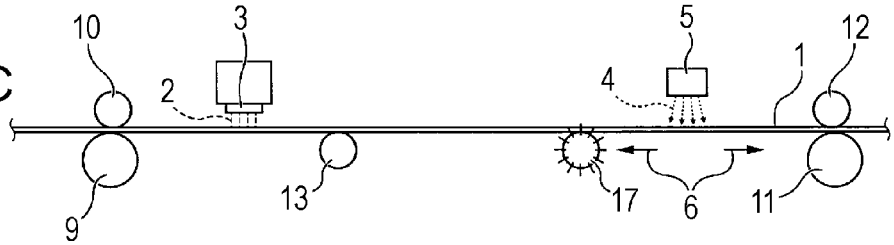
Figure 4D:
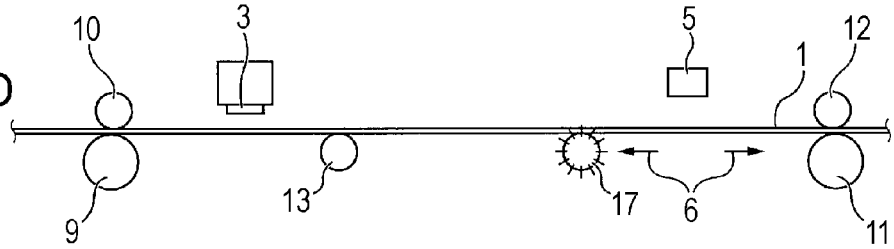

The printing medium 1 is transported in the transport direction 16, and the transport is stopped when the position onto which the UV ink 2 has been discharged reaches a light irradiation region of the light irradiation section 5 (FIGS. 4A and 4B). Further, the tension 6 is applied to a portion of the printing medium 1 that faces the light irradiation region of the light irradiation section 5 using the tension application mechanism 7 (FIG. 4B). Further, UV light is irradiated (FIG. 4C). At this time, the ink discharge section 3 is driven and UV ink 2 is discharged onto the ink discharge region of the printing medium 1. Once light irradiation and ink discharge have been completed (FIG. 4D), the application of the tension 6 is removed, and the transport of the printing medium 1 is resumed (FIG. 4E).

Figure 4E:
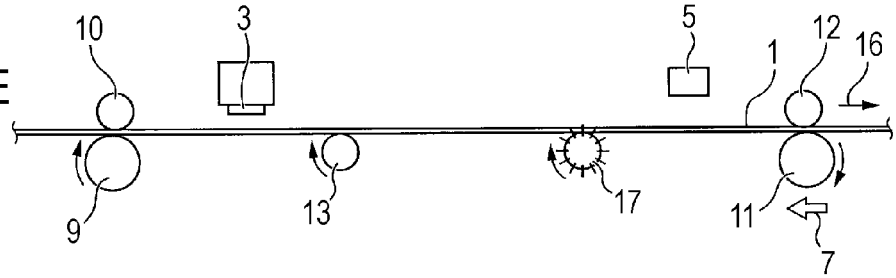

According to the embodiment, unlike the first embodiment, it is possible to perform the application of the tension 6 to the printing medium 1 and the removal of the tension 6 from the printing medium 1 with respect to a fixed structure in which the ink discharge section 3 and the light irradiation section 5 do not move in the transport direction 16 (FIGS. 4B and 4E). That is, it is also possible to have a structure in which the light irradiation section 5 is positioned further downstream in the transport direction 16 of the printing medium 1 than the ink discharge section 3 and the printing medium 1 is transported so as to receive ink discharge and light irradiation by the positions that the ink discharge section 3 and the light irradiation section 5 face being sequentially passed thereover.

In addition, since the tension application mechanism 7 is configured of a combination of the needle-tipped roller 17 and the friction transfer rollers 11 and 12, in addition to a function of transporting the printing medium 1 in the transport direction 16, it is possible to cause the friction transfer rollers 11 and 12 and the like to serve a function of applying the tension, and it is possible to prevent an increase in the number of components.

Fifth Embodiment

FIG. 7

Figure 7:
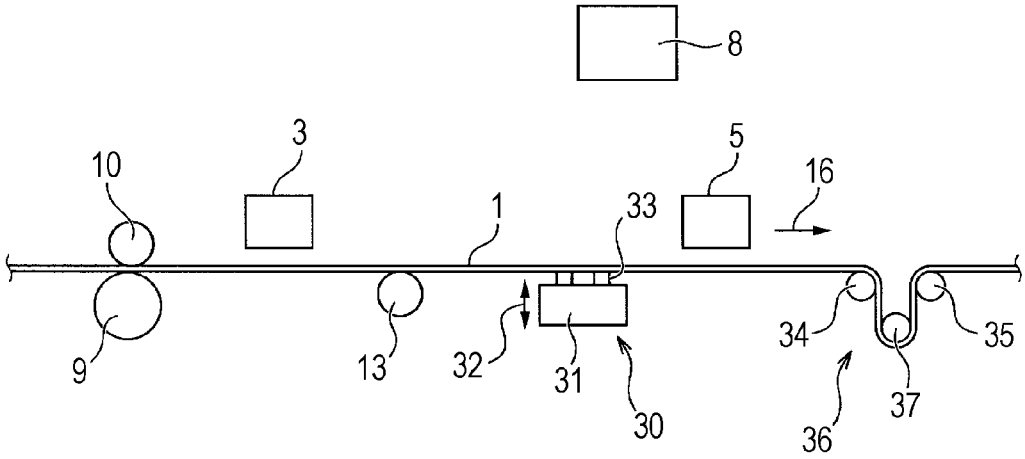
FIG. 7 is a sectional side view that shows a skeleton framework of the main parts of a printing apparatus that uses photocurable ink according to the fifth embodiment of the invention.

As shown in FIG. 7, in a printing apparatus that uses photocurable ink according to the fifth embodiment of the invention, the tension application mechanism 7 includes a medium retention section 30 that is provided upstream of the light irradiation section 5 and on the side of the printing medium 1 that is opposite the light irradiation section 5, and a tension adjustment section 36 that is provided further downstream in the transport direction 16 than the light irradiation section 5.

In the embodiment, the medium retention section 30 is provided upstream of the light irradiation section 5 and on the side of the printing medium 1 that is opposite the light irradiation section 5, and includes a needle-tipped member 31 that performs a contact/separation movement with the surface of the above-referenced opposite side of the printing medium 1 using a movement mechanism 32. The needle-tipped member 31 includes a needle 33. In addition, the tension adjustment section 36 is provided further downstream than the light irradiation section 5 and includes a tension application roller 37 that moves in a vertical direction that intersects the transport direction 16.

That is, by moving the tension application roller 37 vertically and changing the position thereof, a load is applied to the printing medium 1 that is retained in a pair of retention rollers 34 and 35, and as a result, a predetermined tension 6 is applied to the printing medium 1.

Additionally, the medium retention section 30 is not limited to the needle-tipped member 31, and the tension adjustment section 36 is not limited to the tension application roller 37. It is possible for the foregoing to respectively have other publicly-known structures.

The control section 8 causes the needle-tipped member 31 and the tension application roller 37 to function and at the time of the irradiation of UV light 4, the tension 6 is applied to a printing medium 1 that is retained between the two components 31 and 37.

According to the fifth embodiment, when ink is cured by UV light 4 being irradiated thereon, the needle-tipped member 31 is moved using a movement mechanism 32 and, with respect to the printing medium 1, is migrated from a separated state which is not shown in the drawings to a contact state which is shown in the drawings, and the printing medium 1 is retained using a needle 33 of the needle-tipped member 31. Further, in the abovementioned retention state, by moving the tension application roller 37 in a direction of tension application, it is possible to apply a predetermined tension 6 to the printing medium 1.

Since the rest of the structure of the printing apparatus is the same as the first embodiment, the same reference numerals apply to the same parts and the description thereof will be omitted.

Other Examples of Tension Application Mechanism

In each of the abovementioned embodiments, the tension application mechanism 7 has a structure in which the tension 6 is applied to a transport direction 16 of a printing medium 1, but a configuration in which the tension is applied in a width direction 21 of the printing medium 1 that intersects the transport direction 16 may also be adopted.

Figure 8:
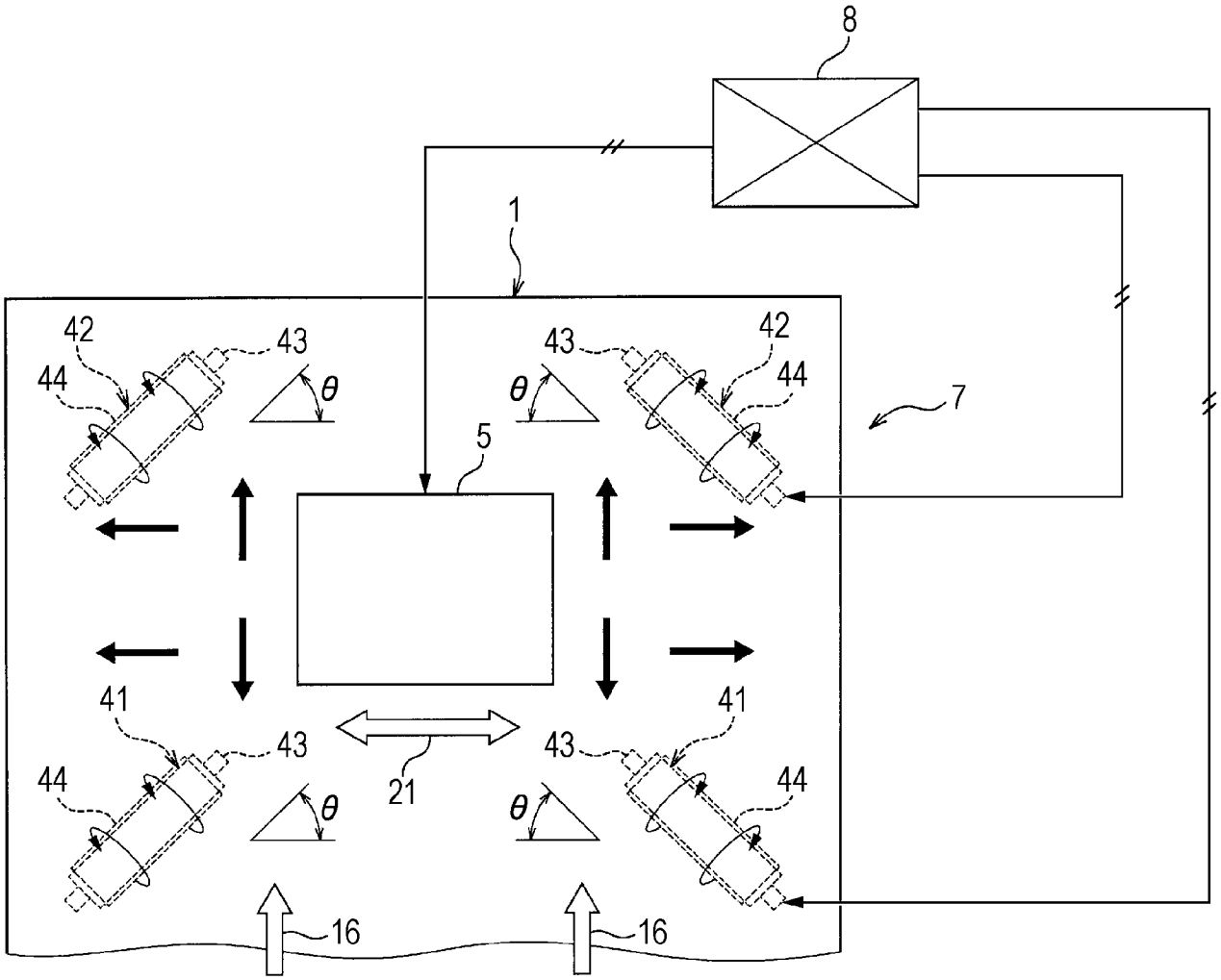
FIG. 8 is a main part outline plan view that shows an embodiment of a tension application mechanism that is also capable of applying the tension in a width direction of a printing medium.

FIG. 8 is a main part outline plan view that shows an example that is capable of applying the tension in the width direction 21.

In the embodiment, the tension application mechanism 7 includes a pair of first inclined rollers 41 and 41 and a pair of second inclined rollers 42 and 42 that are symmetrically (line symmetry) disposed in an upstream position of the transport direction 16 and a downstream position pinching the target tension application portion of the printing medium 1 with a pair on the left and right in a width direction B. An adhesive is applied to the roller surfaces 44 of the pair of first inclined rollers 41 and 41 and the pair of second inclined rollers 42 and 42 in order to increase the gripping power (retention power) thereof with respect to the printing medium 1. Instead of the adhesive, the roller surfaces 44 may be formed by pasting an adhesive sheet thereto, forming an uneven pattern that improves gripping power thereon or using a rubber material or the like with a high coefficient of friction.

In the pair of first inclined rollers 41 and 41 that is positioned upstream, the direction of each roller axis 43 is symmetrically inclined by an angle θ with respect to the transport direction 16 of the printing medium 1. That is, the pair of first inclined rollers 41 and 41 is symmetrically inclined by an angle θ with two equilateral relationship of isosceles triangles. In addition, in the same manner as the pair of first inclined rollers 41 and 41, in the pair of second inclined rollers 42 and 42 that is positioned downstream, the direction of each roller axis 43 thereof is symmetrically inclined by an angle θ. The inclination angle θ may be changed using a publicly known mechanism that is not shown in the drawings.

The pair of first inclined rollers 41 and 41 is rotated by a first motor that is not shown in the drawings. The pair of second inclined rollers 42 and 42 is rotated by a second motor that is not shown in the drawings which is separate from the first motor.

Further, the rotation speed of the pair of second inclined rollers 42 and 42 which is positioned downstream is set to be faster than the rotation speed of the pair of first inclined rollers 41 and 41 which is positioned upstream. The apparatus is configured so that the tension is applied to a printing medium 1 supported between the pair of first inclined rollers 41 and 41 and the pair of second inclined rollers 42 and 42 in both the transport direction 16 and the width direction 21 according to this speed difference.

In addition, the size of the tensions of the transport direction 16 and the width direction 21 on the printing medium 1 can be adjusted by changing the inclination angle θ. In a case in which the inclination angle θ is set to 45°, the sizes of the respective tensions of the transport direction 16 and the width direction 21 are equal.

In addition, in the case of the embodiment, with respect to a printing medium 1 with different coefficients of extension in the transport direction 16 and width direction 21, it is possible to easily apply suitable tensions to the respective directions 16 and 21 and execute printing by merely changing the inclination angles θ of the pair of first inclined rollers 41 and 41 and the pair of second inclined rollers 42 and 42.

Other Embodiments

The printing apparatus that uses photocurable ink and method for producing a printed material according to the invention a based on the above-described configurations, but naturally it is possible to perform modifications, adaptations or the like of partial configurations provided the foregoing are within a range that does not depart from the scope of the invention of the application.

In the abovementioned embodiments, it is preferable that an elevation mechanism which can move the ink discharge section 3 vertically be included. In a case in which the tension 6 is applied to the printing medium 1 using the tension application mechanism 7, the control section 8 moves the abovementioned elevation mechanism and the ink discharge section 3 is raised to a position higher than that during ink discharge.

When the tension 6 is applied to the printing medium 1, there is concern that the printing medium 1 will vibrate up and down as a result of the reaction thereof, and a concern that the printing medium 1 will come into contact with the ink discharge section 3 as a result of these vibrations. As a result of the elevation mechanism, by temporarily raising the ink discharge section 3 during the application of the tension 6, it is possible to suppress the smearing of ink attached to the ink discharge section 3 on the printing medium 1 and damage to the ink discharge section 3 as a result of contact between the ink discharge section 3 and the printing medium 1.

The entire disclosure of Japanese Patent Application No. 2012-023270, filed Feb. 6, 2012 is expressly incorporated by reference herein.

What is claimed is:

1. A printing apparatus that uses photocurable ink comprising:

an ink discharge section that discharges photocurable ink onto a printing medium;

a light irradiation section that irradiates curing light onto the photocurable ink that has been discharged onto the printing medium;

a tension application mechanism that applies a tension to the printing medium; and a control section that controls the respective actions of the ink discharge section, the light irradiation section and the tension application mechanism, wherein the control section discharges the photocurable ink onto the printing medium by controlling the ink discharge section, subsequently applies a first tension, which is greater than a discharge tension which is applied that at the time of ink discharge, to the printing medium by controlling the tension application mechanism, and causes curing light to be irradiated from the light irradiation section onto the photocurable ink that has been discharged onto the printing medium in a state in which the first tension is being applied to the printing medium.

2. The printing apparatus that uses photocurable ink according to claim 1, wherein after the first tension has been applied to the printing medium, the control section causes curing light to be irradiated from the light irradiation section onto the photocurable ink that has been discharged onto the printing medium in a state in which a second tension, which is smaller than the first tension that was applied to the printing medium, is being applied to the printing medium.

3. The printing apparatus that uses photocurable ink according to claim 1, wherein the ink discharge section and the light irradiation section move along a transport direction of the printing medium, and the control section discharges photocurable ink while moving the ink discharge section in the transport direction, and subsequently irradiates curing light onto the photocurable ink that has been discharged onto the printing medium while moving the light irradiation section along the transport direction in a state in which the discharge tension is being applied to the printing medium.

4. The printing apparatus that uses photocurable ink according to claim 1, wherein the light irradiation section is positioned further downstream in the transport direction of the printing medium than the ink discharge section, wherein the tension application mechanism includes a medium retention section that is provided upstream of the light irradiation section and a tension adjustment section that is provided downstream of the light irradiation section.

5. The printing apparatus that uses photocurable ink according to claim 4, wherein the medium retention section includes a needle-tipped member that performs a contact/separation movement with a back surface of the printing medium, and the tension adjustment section includes a tension application roller that moves in a direction that intersects the transport direction.

6. The printing apparatus that uses photocurable ink according to claim 1, wherein the light irradiation section is positioned further downstream in the transport direction of the printing medium than the ink discharge section, the tension application mechanism includes a first medium retention section that is provided upstream of the light irradiation section and a second medium retention section that is provided further downstream in the transport direction than the light irradiation section.

7. The printing apparatus that uses photocurable ink according to claim 6, wherein the first medium retention section includes a needle-tipped roller that is provided upstream of the light irradiation section, and the second medium retention section includes a friction transfer roller that is provided further downstream than the light irradiation section.

8. The printing method according to claim 1, wherein ink has photocurable property, further comprising:

irradiating curing light to the printing medium while applying the first tension after discharging ink onto the printing medium.

9. The printing method according to claim 1, wherein ink has photocurable property, further comprising:

irradiating curing light to the printing medium while applying a second tension which is smaller than the first tension after the discharging ink onto the printing medium.

* * * * *